US010329860B2

(12) United States Patent
Boutalbi et al.

(10) Patent No.: US 10,329,860 B2
(45) Date of Patent: Jun. 25, 2019

(54) MANAGED PRESSURE DRILLING SYSTEM HAVING WELL CONTROL MODE

(71) Applicant: Weatherford Technology Holdings, LLC, Houston, TX (US)

(72) Inventors: Said Boutalbi, Houston, TX (US); Michael Brian Grayson, Sugar Land, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 15/426,229

(22) Filed: Feb. 7, 2017

(65) Prior Publication Data

US 2017/0145764 A1 May 25, 2017

Related U.S. Application Data

(63) Continuation of application No. 13/965,380, filed on Aug. 13, 2013, now abandoned.

(Continued)

(51) Int. Cl.

*E21B 21/08* (2006.01)
*E21B 21/10* (2006.01)

(Continued)

(52) U.S. Cl.

CPC ..... *E21B 21/08* (2013.01); *E21B 7/12* (2013.01); *E21B 21/001* (2013.01); *E21B 21/01* (2013.01);

(Continued)

(58) Field of Classification Search

CPC ..... E21B 21/08; E21B 21/10; E21B 21/103; E21B 21/106; E21B 21/01; E21B 21/001;

(Continued)

(56) References Cited

U.S. PATENT DOCUMENTS 2,947,318 A 8/1960 Odom
3,470,971 A 10/1969 Dower (Continued)

FOREIGN PATENT DOCUMENTS

WO 2007092956 A2 8/2007
WO 2007092956 A3 8/2007

(Continued)

OTHER PUBLICATIONS

European Extended Search Report dated Jun. 8, 2017, for EP Patent Application No. 17158154.9, 8 pgs.

(Continued)

*Primary Examiner* — Nicole Coy
*Assistant Examiner* — Tara E Schimpf
(74) *Attorney, Agent, or Firm* — Patterson + Sheridan, LLP

(57) ABSTRACT

A method of drilling a subsea wellbore includes drilling the subsea wellbore and, while drilling the subsea wellbore: measuring a flow rate of the drilling fluid injected into a tubular string; measuring a flow rate of returns; comparing the returns flow rate to the drilling fluid flow rate to detect a kick by a formation being drilled; and exerting backpressure on the returns using a first variable choke valve. The method further includes, in response to detecting the kick: closing a blowout preventer of a subsea pressure control assembly (PCA) against the tubular string; and diverting the flow of returns from the PCA, through a choke line having a second variable choke valve, and through the first variable choke valve.

24 Claims, 8 Drawing Sheets

Related U.S. Application Data

(60) Provisional application No. 61/682,841, filed on Aug. 14, 2012.

(51) Int. Cl.

| | |
|---|---|
| ***E21B 21/01*** | (2006.01) |
| ***E21B 7/12*** | (2006.01) |
| ***E21B 21/00*** | (2006.01) |
| ***E21B 33/064*** | (2006.01) |
| ***E21B 33/08*** | (2006.01) |

(52) U.S. Cl.
CPC ..... *E21B 21/10* (2013.01); *E21B 21/106* (2013.01); *E21B 33/064* (2013.01); *E21B 33/085* (2013.01)

(58) Field of Classification Search
CPC . E21B 17/01; E21B 7/12; E21B 33/06; E21B 33/064; E21B 33/068; E21B 33/076; E21B 44/00
See application file for complete search history.

(56) References Cited

U.S. PATENT DOCUMENTS

| | | | | |
|---|---|---|---|---|
| 3,946,559 | A | 3/1976 | Stevenson | |
| 4,565,086 | A | 1/1986 | Orr, Jr. | |
| 4,887,464 | A | 12/1989 | Tannenbaum et al. | |
| 6,374,925 | B1 | 4/2002 | Elkins et al. | |
| 6,527,062 | B2 | 3/2003 | Elkins et al. | |
| 6,668,943 | B1 | 12/2003 | Maus et al. | |
| 6,904,981 | B2 | 6/2005 | van Riet | |
| 6,920,942 | B2 | 7/2005 | Koederitz | |
| 7,044,239 | B2 | 5/2006 | Pinckard et al. | |
| 7,111,503 | B2 | 9/2006 | Brumboiu et al. | |
| 7,185,719 | B2 | 3/2007 | van Riet | |
| 7,407,019 | B2 | 8/2008 | Kinder et al. | |
| 7,836,973 | B2 | 11/2010 | Belcher et al. | |
| 2002/0007968 | A1 | 1/2002 | Gardes | |
| 2002/0108783 | A1 | 8/2002 | Elkins et al. | |
| 2002/0112888 | A1 | 8/2002 | Leuchtenberg | |
| 2003/0024737 | A1 | 2/2003 | Chang et al. | |
| 2003/0079912 | A1 | 5/2003 | Leuchtenberg | |
| 2003/0168258 | A1 | 9/2003 | Koederitz | |
| 2003/0196804 | A1 | 10/2003 | Riet | |
| 2004/0144565 | A1 | 7/2004 | Koederitz | |
| 2004/0178003 | A1 | 9/2004 | Riet | |
| 2007/0151762 | A1 | 7/2007 | Reitsma | |
| 2008/0029306 | A1 | 2/2008 | Krueger et al. | |
| 2008/0060846 | A1* | 3/2008 | Belcher | E21B 17/042 175/25 |
| 2008/0105434 | A1 | 5/2008 | Orbell et al. | |
| 2010/0147591 | A1* | 6/2010 | Pomerleau | E21B 21/08 175/61 |
| 2011/0024195 | A1 | 2/2011 | Hoyer et al. | |
| 2011/0042076 | A1* | 2/2011 | Reitsma | E21B 21/08 166/250.01 |
| 2011/0139464 | A1* | 6/2011 | Henderson | E21B 21/01 166/370 |
| 2011/0259584 | A1* | 10/2011 | Broussard, II | E21B 34/02 166/271 |
| 2013/0192841 | A1 | 8/2013 | Feasey et al. | |

FOREIGN PATENT DOCUMENTS

| | | | |
|---|---|---|---|
| WO | 2011047236 | A1 | 4/2011 |
| WO | 2011058031 | A2 | 5/2011 |
| WO | 2011058031 | A3 | 5/2011 |
| WO | 2011109748 | A1 | 9/2011 |

OTHER PUBLICATIONS

Weatherford Magazine, Mar. 2012, vol. 14, No. 1.
Ian Atkinson et al., A New Horizon in Multiphase Flow Measurement, Oilfield Review, Winter 2004/2005, pp. 52-63.
Australian Examination Report dated Jun. 13, 2017, for Australian Patent Application No. 2016202031.
Australian Examination Report dated Sep. 20, 2017, for Australian Patent Application No. 2016202031.
Australian Examination Report dated Dec. 21, 2017, for Australian Patent Application No. 2016202031.
Australian Examination Report dated Mar. 28, 2018, for Australian Patent Application No. 2016202031.
EPO Office Action dated Nov. 6, 2018, for European Application No. 17158154.9.

* cited by examiner

| MODE | 11 | 38a | 38b | 38c | 38d | 38e | 38f | 38g | 38h |
|---|---|---|---|---|---|---|---|---|---|
| DRILL | Open | Open | Closed | Closed | Open | Open | Closed | Open | Closed |
| DEGAS | Closed | Open | Closed | Closed | Open | Closed | Open | Closed | Open |
| WELL CONTROL | Open | Closed | Open | Closed | Open | Closed | Open | Closed | Open |
| EMERGENCY | Open | Closed | Closed | Open | Closed | Open | Open | Closed | Open |

MANAGED PRESSURE DRILLING SYSTEM HAVING WELL CONTROL MODE

BACKGROUND OF THE DISCLOSURE

Field of the Disclosure

The present disclosure generally relates to a managed pressure drilling system having a well control mode.

Description of the Related Art

In wellbore construction and completion operations, a wellbore is formed to access hydrocarbon-bearing formations (e.g., crude oil and/or natural gas) by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Deep water off-shore drilling operations are typically carried out by a mobile offshore drilling unit (MODU), such as a drill ship or a semi-submersible, having the drilling rig aboard and often make use of a marine riser extending between the wellhead of the well that is being drilled in a subsea formation and the MODU. The marine riser is a tubular string made up of a plurality of tubular sections that are connected in end-to-end relationship. The riser allows return of the drilling mud with drill cuttings from the hole that is being drilled. Also, the marine riser is adapted for being used as a guide means for lowering equipment (such as a drill string carrying a drill bit) into the hole.

SUMMARY OF THE DISCLOSURE

The present disclosure generally relates to a managed pressure drilling system having a well control mode. In one embodiment, a method of drilling a subsea wellbore includes drilling the subsea wellbore by: injecting drilling fluid through a tubular string extending into the wellbore from an offshore drilling unit (ODU); and rotating a drill bit disposed on a bottom of the tubular string. The drilling fluid exits the drill bit and carries cuttings from the drill bit. The drilling fluid and cuttings (returns) flow to a subsea wellhead via an annulus defined by an outer surface of the tubular string and an inner surface of the subsea wellbore. The returns flow from the subsea wellhead to the ODU via a marine riser. The method further includes, while drilling the subsea wellbore: measuring a flow rate of the drilling fluid injected into the tubular string; measuring a flow rate of the returns; comparing the returns flow rate to the drilling fluid flow rate to detect a kick by a formation being drilled; and exerting backpressure on the returns using a first variable choke valve. The method further includes, in response to detecting the kick: closing a blowout preventer of a subsea pressure control assembly (PCA) against the tubular string; and diverting the flow of returns from the PCA, through a choke line having a second variable choke valve, and through the first variable choke valve.

In another embodiment, a managed pressure drilling system includes: a first rotating control device (RCD) for connection to a marine riser; a first variable choke valve for connection to an outlet of the first RCD; a first mass flow meter for connection to an outlet of the first variable choke valve; a splice for connecting an inlet of the first variable choke valve to an outlet of a second variable choke valve; and a programmable logic controller (PLC) in communication with the first variable choke valve and the first mass flow meter. The PLC is configured to perform an operation, including, during drilling of a subsea wellbore: measuring a flow rate of returns using the first mass flow meter; comparing the returns flow rate to a drilling fluid flow rate to detect a kick by a formation being drilled; and exerting backpressure on the returns using the first variable choke valve. The operation further includes, in response to detecting the kick, diverting the returns through the second variable choke valve, the splice, and the first variable choke valve to alleviate pressure on the first variable choke valve.

In another embodiment, a method of drilling a subsea wellbore includes: drilling the subsea wellbore; and, while drilling the subsea wellbore: measuring a flow rate of drilling fluid injected into a tubular string having a drill bit; measuring a flow rate of drilling returns using a subsea mass flow meter; and comparing the returns flow rate to the drilling fluid flow rate to detect a kick by a formation being drilled. The method further includes, in response to detecting the kick: closing a blowout preventer of a subsea pressure control assembly (PCA) against the tubular string; and diverting the flow of returns from the PCA, through a choke line having a second variable choke valve, and through a first variable choke valve.

In another embodiment, a managed pressure drilling system includes: a first rotating control device (RCD) for connection to a marine riser; a first variable choke valve for connection to an outlet of the first RCD; a first mass flow meter for connection to an outlet of the first variable choke valve; a splice for connecting an inlet of the first variable choke valve to an outlet of a second variable choke valve; a second RCD for assembly as part of a subsea pressure control assembly; a subsea mass flow meter for connection to an outlet of the second RCD; and a programmable logic controller (PLC) in communication with the first variable choke valve and the first and second mass flow meters.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
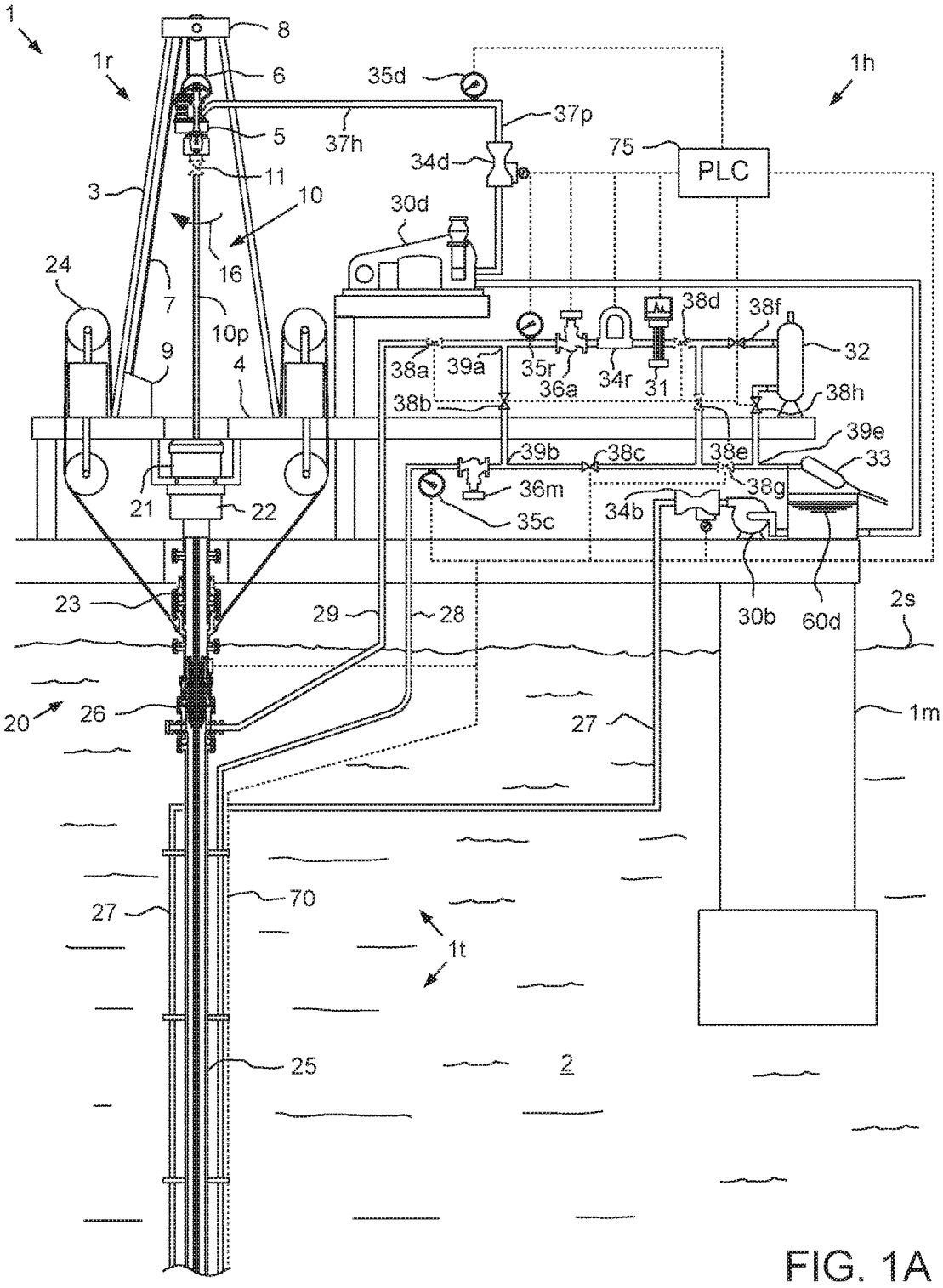
FIGS. 1A-1C illustrate an offshore drilling system in a managed pressure drilling mode, according to one embodiment of the present disclosure.
Figure 1B:
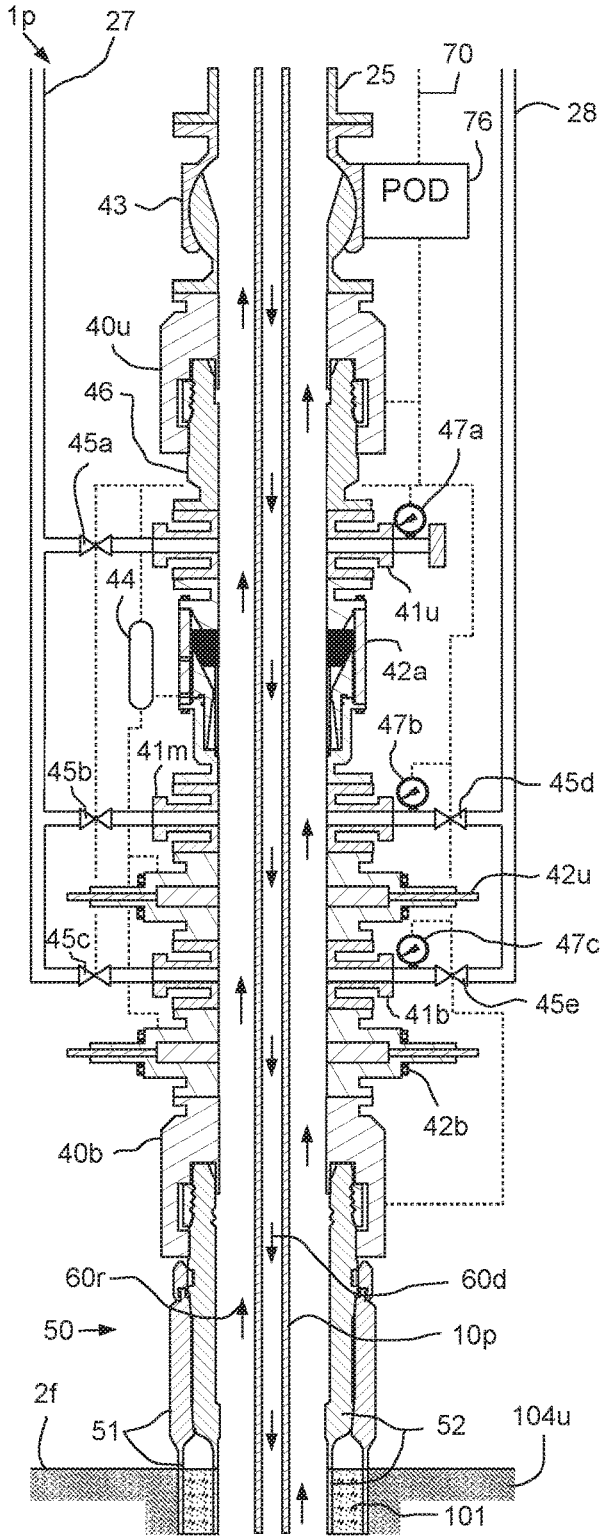
Figure 1C:
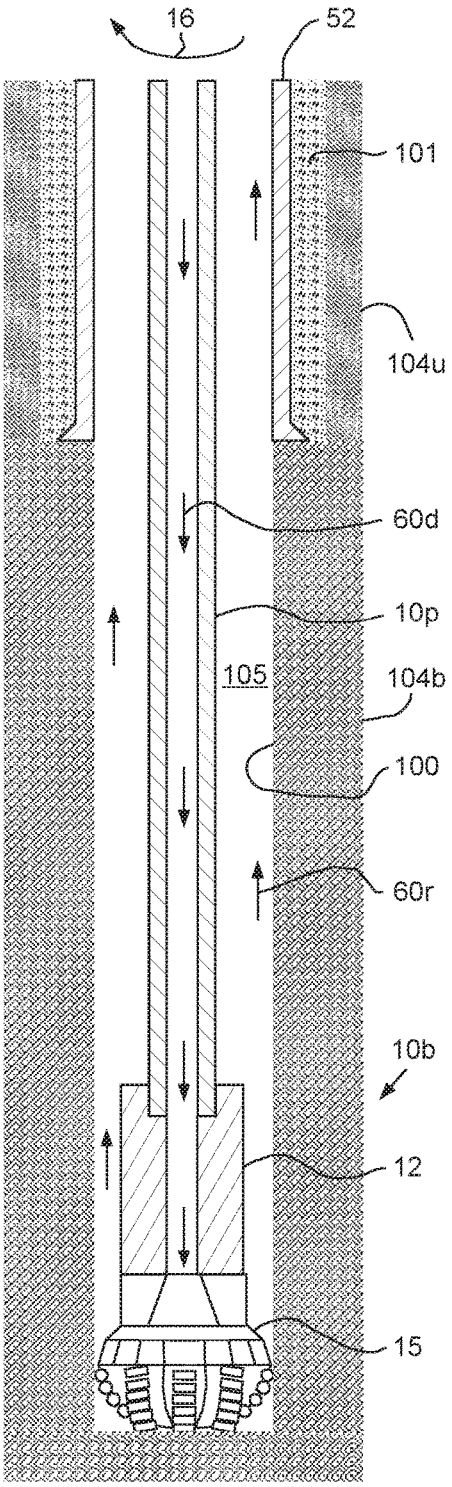

FIGS. 1A-1C illustrate an offshore drilling system 1 in a managed pressure drilling mode, according to one embodiment of the present disclosure. The drilling system 1 may include a MODU 1*m*, such as a semi-submersible, a drilling rig 1*r*, a fluid handling system 1*h*, a fluid transport system it, and pressure control assembly (PCA) 1*p*, and a drill string 10. The MODU 1*m* may carry the drilling rig 1*r* and the fluid handling system 1*h* aboard and may include a moon pool, through which drilling operations are conducted. The semi-submersible may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 50.

Alternatively, the MODU 1*m* may be a drill ship. Alternatively, a fixed offshore drilling unit or a non-mobile floating offshore drilling unit may be used instead of the MODU 1*m*. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

The drilling rig 1*r* may include a derrick 3, a floor 4, a top drive 5, and a hoist. The top drive 5 may include a motor for rotating 16 a drill string 10. The top drive motor may be electric or hydraulic. A frame of the top drive 5 may be linked to a rail (not shown) of the derrick 3 for preventing rotation thereof during rotation 16 of the drill string 10 and allowing for vertical movement of the top drive with a traveling block 6 of the hoist. The frame of the top drive 5 may be suspended from the derrick 3 by the traveling block 6. A Kelly valve 11 may be connected to a quill of a top drive 5. The quill may be torsionally driven by the top drive motor and supported from the frame by bearings. The top drive 5 may further have an inlet connected to the frame and in fluid communication with the quill.

The traveling block 6 may be supported by wire rope 7 connected at its upper end to a crown block 8. The wire rope 7 may be woven through sheaves of the blocks 6, 8 and extend to drawworks 9 for reeling thereof, thereby raising or lowering the traveling block 6 relative to the derrick 3. The drilling rig 1*r* may further include a drill string compensator (not shown) to account for heave of the MODU 1*m*. The drill string compensator may be disposed between the traveling block 6 and the top drive 5 (aka hook mounted) or between the crown block 8 and the derrick 3 (aka top mounted).

An upper end of the drill string 10 may be connected to the Kelly valve 11, such as by threaded couplings. The drill string 10 may include a bottomhole assembly (BHA) 10*b* and joints of drill pipe 10*p* connected together, such as by threaded couplings. The BHA 10*b* may be connected to the drill pipe 10*p*, such as by threaded couplings, and include a drill bit 15 and one or more drill collars 12 connected thereto, such as by threaded couplings. The drill bit 15 may be rotated 16 by the top drive 5 via the drill pipe 10*p* and/or the BHA 10*b* may further include a drilling motor (not shown) for rotating the drill bit. The BHA 10*b* may further include an instrumentation sub (not shown), such as a measurement while drilling (MWD) and/or a logging while drilling (LWD) sub.

The fluid transport system 1*t* may include an upper marine riser package (UMRP) 20, a marine riser 25, a booster line 27, a choke line 28, and a return line 29. The UMRP 20 may include a diverter 21, a flex joint 22, a slip (aka telescopic) joint 23, a tensioner 24, and a rotating control device (RCD) 26. A lower end of the RCD 26 may be connected to an upper end of the riser 25, such as by a flanged connection. The slip joint 23 may include an outer barrel connected to an upper end of the RCD 26, such as by a flanged connection, and an inner barrel connected to the flex joint 22, such as by a flanged connection. The outer barrel may also be connected to the tensioner 24, such as by a tensioner ring (not shown).

The flex joint 22 may also connect to the diverter 21, such as by a flanged connection. The diverter 21 may also be connected to the rig floor 4, such as by a bracket. The slip joint 23 may be operable to extend and retract in response to heave of the MODU 1*m* relative to the riser 25 while the tensioner 24 may reel wire rope in response to the heave, thereby supporting the riser 25 from the MODU 1*m* while accommodating the heave. The riser 25 may extend from the PCA 1*p* to the MODU 1*m* and may connect to the MODU via the UMRP 20. The riser 25 may have one or more buoyancy modules (not shown) disposed therealong to reduce load on the tensioner 24.

The RCD 26 may include a docking station and a bearing assembly. The docking station may be submerged adjacent the waterline 2*s*. The docking station may include a housing, a latch, and an interface. The RCD housing may be tubular and have one or more sections connected together, such as by flanged connections. The RCD housing may have one or more fluid ports formed through a lower housing section and the docking station may include a connection, such as a flanged outlet, fastened to one of the ports.

The latch may include a hydraulic actuator, such as a piston, one or more fasteners, such as dogs, and a body. The latch body may be connected to the housing, such as by threaded couplings. A piston chamber may be formed between the latch body and a mid housing section. The latch body may have openings formed through a wall thereof for receiving the respective dogs. The latch piston 63*p* may be disposed in the chamber and may carry seals isolating an upper portion of the chamber from a lower portion of the chamber. A cam surface may be formed on an inner surface of the piston for radially displacing the dogs. The latch body may further have a landing shoulder formed in an inner surface thereof for receiving a protective sleeve or the bearing assembly.

Hydraulic passages may be formed through the mid housing section and may provide fluid communication between the interface and respective portions of the hydraulic chamber for selective operation of the piston. An RCD umbilical may have hydraulic conduits and may provide fluid communication between the RCD interface and a hydraulic power unit (HPU) via hydraulic manifold. The RCD umbilical may further have an electric cable for providing data communication between a control console and the RCD interface via a controller.

The bearing assembly may include a catch sleeve, one or more strippers, and a bearing pack. Each stripper may include a gland or retainer and a seal. Each stripper seal may be directional and oriented to seal against drill pipe 10*p* in response to higher pressure in the riser 25 than the UMRP 20. Each stripper seal may have a conical shape for fluid pressure to act against a respective tapered surface thereof, thereby generating sealing pressure against the drill pipe 10*p*. Each stripper seal may have an inner diameter slightly less than a pipe diameter of the drill pipe 10*p* to form an interference fit therebetween. Each stripper seal may be flexible enough to accommodate and seal against threaded couplings of the drill pipe 10*p* having a larger tool joint diameter. The drill pipe 10*p* may be received through a bore of the bearing assembly so that the stripper seals may engage the drill pipe 10*p*. The stripper seals may provide a desired barrier in the riser 25 either when the drill pipe 10*p* is stationary or rotating.

The catch sleeve may have a landing shoulder formed at an outer surface thereof, a catch profile formed in an outer surface thereof, and may carry one or more seals on an outer surface thereof. Engagement of the latch dogs with the catch sleeve may connect the bearing assembly to the docking station. The gland may have a landing shoulder formed in an inner surface thereof and a catch profile formed in an inner surface thereof for retrieval by a bearing assembly running tool. The bearing pack may support the strippers from the catch sleeve such that the strippers may rotate relative to the docking station. The bearing pack may include one or more radial bearings, one or more thrust bearings, and a self contained lubricant system. The bearing pack may be disposed between the strippers and be housed in and connected to the catch sleeve, such as by threaded couplings and/or fasteners.

Alternatively, the bearing assembly may be non-releasably connected to the housing. Alternatively, the RCD may be located above the waterline and/or along the UMRP at any other location besides a lower end thereof. Alternatively, the RCD may be assembled as part of the riser at any location therealong or as part of the PCA. Alternatively, an active seal RCD may be used instead.

The PCA 1*p* may be connected to a wellhead 50 adjacently located to a floor 2*f* of the sea 2. A conductor string 51 may be driven into the seafloor 2*f*. The conductor string 51 may include a housing and joints of conductor pipe connected together, such as by threaded couplings. Once the conductor string 51 has been set, a subsea wellbore 100 may be drilled into the seafloor 2*f* and a casing string 52 may be deployed into the wellbore. The casing string 52 may include a wellhead housing and joints of casing connected together, such as by threaded couplings. The wellhead housing may land in the conductor housing during deployment of the casing string 52. The casing string 52 may be cemented 101 into the wellbore 100. The casing string 52 may extend to a depth adjacent a bottom of an upper formation 104*u*. The upper formation 104*u* may be non-productive and a lower formation 104*b* may be a hydrocarbon-bearing reservoir.

Alternatively, the lower formation 104*b* may be non-productive (e.g., a depleted zone), environmentally sensitive, such as an aquifer, or unstable. Although shown as vertical, the wellbore 100 may include a vertical portion and a deviated, such as horizontal, portion.

The PCA 1*p* may include a wellhead adapter 40*b*, one or more flow crosses 41*u,m,b*, one or more blow out preventers (BOPs) 42*a,u,b*, a lower marine riser package (LMRP), one or more accumulators 44, and a receiver 46. The LMRP may include a control pod 76, a flex joint 43, and a connector 40*u*. The wellhead adapter 40*b*, flow crosses 41*u,m,b*, BOPs 42*a,u,b*, receiver 46, connector 40*u*, and flex joint 43, may each include a housing having a longitudinal bore therethrough and may each be connected, such as by flanges, such that a continuous bore is maintained therethrough. The bore may have drift diameter, corresponding to a drift diameter of the wellhead 50. The flex joints 23, 43 may accommodate respective horizontal and/or rotational (aka pitch and roll) movement of the MODU 1*m* relative to the riser 25 and the riser relative to the PCA 1*p*.

Each of the connector 40*u* and wellhead adapter 40*b* may include one or more fasteners, such as dogs, for fastening the LMRP to the BOPs 42*a,u,b* and the PCA 1*p* to an external profile of the wellhead housing, respectively. Each of the connector 40*u* and wellhead adapter 40*b* may further include a seal sleeve for engaging an internal profile of the respective receiver 46 and wellhead housing. Each of the connector 40*u* and wellhead adapter 40*b* may be in electric or hydraulic communication with the control pod 76 and/or further include an electric or hydraulic actuator and an interface, such as a hot stab, so that a remotely operated subsea vehicle (ROV) (not shown) may operate the actuator for engaging the dogs with the external profile.

The LMRP may receive a lower end of the riser 25 and connect the riser to the PCA 1*p*. The control pod 76 may be in electric, hydraulic, and/or optical communication with a programmable logic controller (PLC) 75 and/or a rig controller (not shown) onboard the MODU 1*m* via an umbilical 70. The control pod 76 may include one or more control valves (not shown) in communication with the BOPs 42*a,u,b* for operation thereof. Each control valve may include an electric or hydraulic actuator in communication with the umbilical 70. The umbilical 70 may include one or more hydraulic and/or electric control conduit/cables for the actuators. The accumulators 44 may store pressurized hydraulic fluid for operating the BOPs 42*a,u,b*. Additionally, the accumulators 44 may be used for operating one or more of the other components of the PCA 1*p*. The PLC 75 and/or rig controller may operate the PCA 1*p* via the umbilical 70 and the control pod 76.

A lower end of the booster line 27 may be connected to a branch of the flow cross 41*u* by a shutoff valve 45*a*. A booster manifold may also connect to the booster line 27 and have a prong connected to a respective branch of each flow cross 41*m,b*. Shutoff valves 45*b,c* may be disposed in respective prongs of the booster manifold. Alternatively, a separate kill line (not shown) may be connected to the branches of the flow crosses 41*m,b* instead of the booster manifold. An upper end of the booster line 27 may be connected to an outlet of a booster pump 30*b*. A lower end of the choke line 28 may have prongs connected to respective second branches of the flow crosses 41*m,b*. Shutoff valves 45*d,e* may be disposed in respective prongs of the choke line lower end.

A pressure sensor 47*a* may be connected to a second branch of the upper flow cross 41*u*. Pressure sensors 47*b,c* may be connected to the choke line prongs between respective shutoff valves 45*d,e* and respective flow cross second branches. Each pressure sensor 47*a-c* may be in data communication with the control pod 76. The lines 27, 28 and umbilical 70 may extend between the MODU 1*m* and the PCA 1*p* by being fastened to brackets disposed along the riser 25. Each line 27, 28 may be a flow conduit, such as coiled tubing. Each shutoff valve 45*a-e* may be automated and have a hydraulic actuator (not shown) operable by the control pod 76.

Alternatively, the umbilical may be extended between the MODU and the PCA independently of the riser. Alternatively, the valve actuators may be electrical or pneumatic.

The fluid handling system 1*h* may include one or pumps 30*b,d*, a gas detector 31, a reservoir for drilling fluid 60*d*, such as a tank, a fluid separator, such as a mud-gas separator (MGS) 32, a solids separator, such as a shale shaker 33, one or more flow meters 34*b,d,r*, one or more pressure sensors 35*c,d,r*, and one or more variable choke valves, such as a managed pressure (MP) choke 36*a* and a well control (WC) choke 36*m*. The mud-gas separator 32 may be vertical, horizontal, or centrifugal and may be operable to separate gas from returns 60*r*. The separated gas may be stored or flared.

Figure 2A:
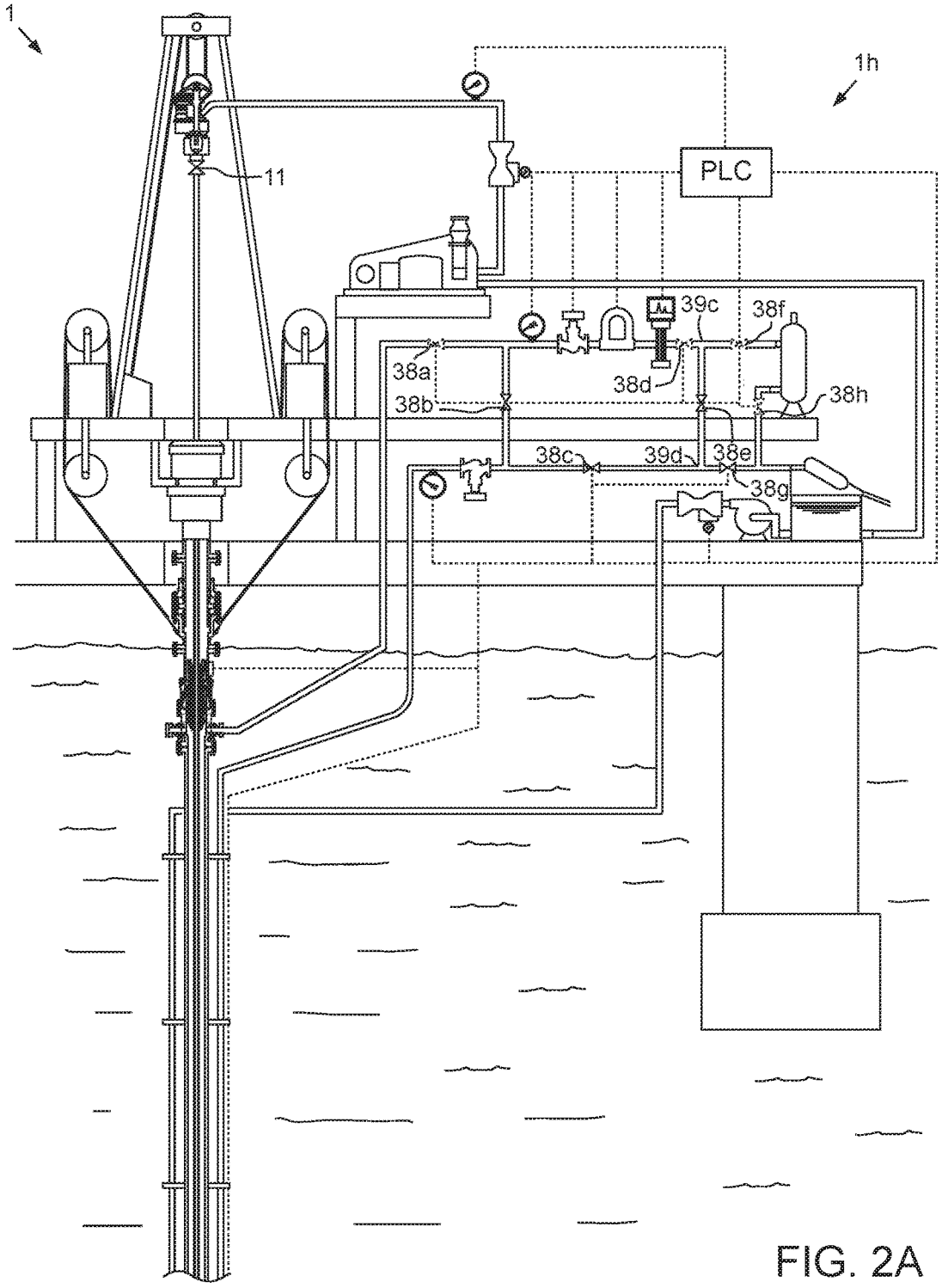
FIGS. 2A and 2B illustrate the offshore drilling system in a managed pressure riser degassing mode.

A lower end of the return line 29 may be connected to an outlet of the RCD 26 and an upper end of the return line may be connected to an inlet stem of a first flow tee 39*a* and have a first shutoff valve 38*a* assembled as part thereof. An upper end of the choke line 28 may be connected an inlet stem of a second flow tee 39*b* and have the WC choke 36*m* and pressure sensor 35*c* assembled as part thereof. A first spool may connect an outlet stem of the first tee 39*a* and an inlet stem of a third tee 39*c* (FIG. 2A). The pressure sensor 35*r*, MP choke 36*a*, flow meter 34*r*, gas detector 31, and a fourth shutoff valve 38*d* may be assembled as part of the first spool. A second spool may connect an outlet stem of the third tee 39*c* and an inlet of the MGS 32 and have a sixth shutoff valve 38*f* assembled as part thereof.

A third spool may connect an outlet stem of the second tee 39*b* and an inlet stem of a fourth tee 39*d* (FIG. 2A) and have a third shutoff valve 38*c* assembled as part thereof. A first splice may connect branches of the first 39*a* and second 39*b* tees and have a second shutoff valve 38*b* assembled as part thereof. A second splice may connect branches of the third 39*c* and fourth 39*d* tees and have a fifth shutoff valve 38*e* assembled as part thereof. A fourth spool may connect an outlet stem of the fourth tee 39*d* and an inlet stem of the fifth tee 39*e* and have a seventh shutoff valve 38*g* assembled as part thereof. A third splice may connect a liquid outlet of the MGS 32 and a branch of the fifth tee 39*e* and have an eighth shutoff valve 38*h* assembled as part thereof. An outlet stem of the fifth tee 39*e* may be connected to an inlet of the shale shaker 33.

A supply line 37*p,h* may connect an outlet of the mud pump 30*d* to the top drive inlet and may have the flow meter 34*d* and the pressure sensor 35*d* assembled as part thereof. An upper end of the booster line 27 may have the flow meter 34*b* assembled as part thereof. Each pressure sensor 35*c,d,r* may be in data communication with the PLC 75. The pressure sensor 35*r* may be operable to monitor backpressure exerted by the MP choke 36*a*. The pressure sensor 35*c* may be operable to monitor backpressure exerted by the WC choke 36*m*. The pressure sensor 35*d* may be operable to monitor standpipe pressure. Each choke 36*a,m* may be fortified to operate in an environment where drilling returns 60*r* may include solids, such as cuttings. The MP choke 36*a* may include a hydraulic actuator operated by the PLC 75 via the HPU to maintain backpressure in the riser 25. The WC choke 36*m* may be manually operated.

Alternatively, the choke actuator may be electrical or pneumatic. Alternatively, the WC choke 36*m* may also include an actuator operated by the PLC 75.

Figures 2B, 2C:
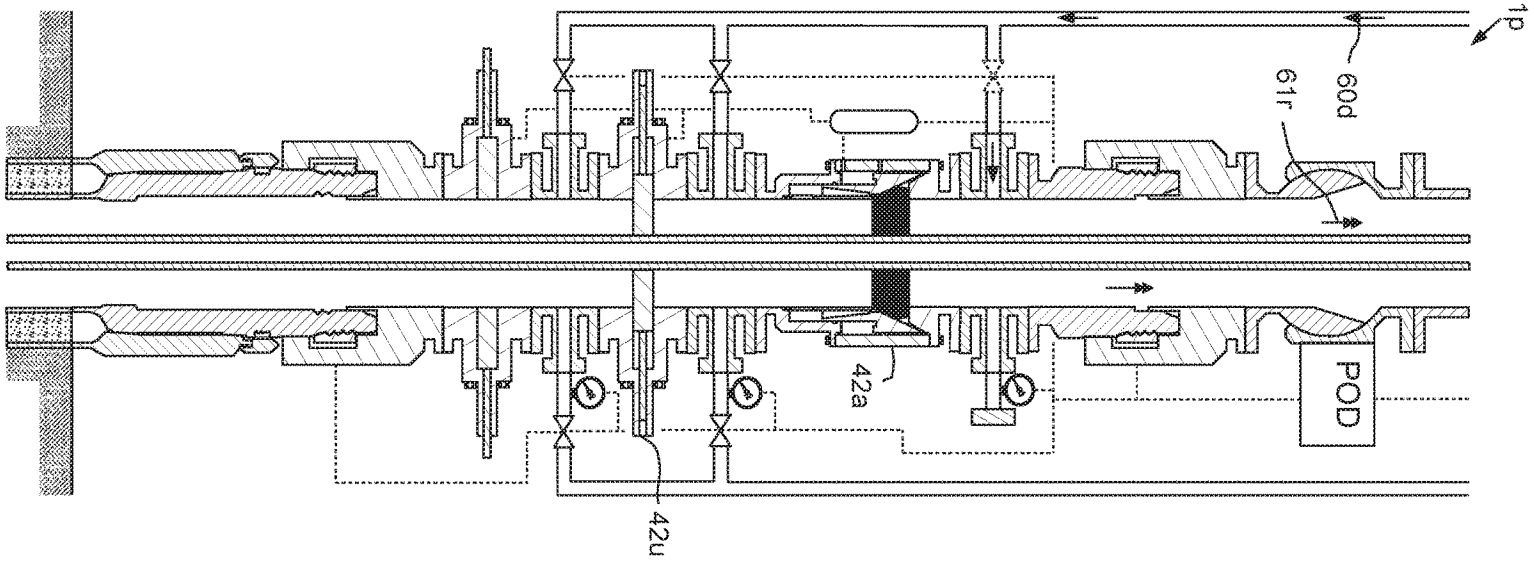
FIG. 2C is a table illustrating switching between the modes.

The flow meter 34*r* may be a mass flow meter, such as a Coriolis flow meter, and may be in data communication with the PLC 75. The flow meter 34*r* may be connected in the first spool downstream of the MP choke 36*a* and may be operable to monitor a flow rate of the drilling returns 60*r*. Each of the flow meters 34*b,d* may be a volumetric flow meter, such as a Venturi flow meter, and may be in data communication with the PLC 75. The flow meter 34*d* may be operable to monitor a flow rate of the mud pump 30*d*. The flow meter 34*b* may be operable to monitor a flow rate of the drilling fluid 60*d* pumped into the riser 25 (FIG. 2B). The PLC 75 may receive a density measurement of drilling fluid 60*d* from a mud blender (not shown) to determine a mass flow rate of the drilling fluid 60*d* from the volumetric measurement of the flow meters 34*b,d*.

Alternatively, a stroke counter (not shown) may be used to monitor a flow rate of the mud pump and/or booster pump instead of the volumetric flow meters. Alternatively, either or both of the volumetric flow meters may be mass flow meters.

The gas detector 31 may be operable to extract a gas sample from the returns 60*r* (if contaminated by formation fluid 62 (FIG. 3C)) and analyze the captured sample to detect hydrocarbons, such as saturated and/or unsaturated C1 to C10 and/or aromatic hydrocarbons, such as benzene, toluene, ethyl benzene and/or xylene, and/or non-hydrocarbon gases, such as carbon dioxide and nitrogen. The gas detector 31 may include a body, a probe, a chromatograph, and a carrier/purge system. The body may include a fitting and a penetrator. The fitting may have end connectors, such as flanges, for connection within the first spool and a lateral connector, such as a flange for receiving the penetrator. The penetrator may have a blind flange portion for connection to the lateral connector, an insertion tube extending from an external face of the blind flange portion for receiving the probe, and a dip tube extending from an internal face thereof for receiving one or more sensors, such as a pressure and/or temperature sensor.

The probe may include a cage, a mandrel, and one or more sheets. Each sheet may include a semi-permeable membrane sheathed by inner and outer protective layers of mesh. The mandrel may have a stem portion for receiving the sheets and a fitting portion for connection to the insertion tube. Each sheet may be disposed on opposing faces of the mandrel and clamped thereon by first and second members of the cage. Fasteners may then be inserted into respective receiving holes formed through the cage, mandrel, and sheets to secure the probe components together. The mandrel may have inlet and outlet ports formed in the fitting portion and in communication with respective channels formed between the mandrel and the sheets. The carrier/purge system may be connected to the mandrel ports and a carrier gas, such as helium, argon, or nitrogen, may be injected into the mandrel inlet port to displace sample gas trapped in the channels by the membranes to the mandrel outlet port. The carrier/purge system may then transport the sample gas to the chromatograph for analysis. The carrier purge system may also be routinely run to purge the probe of condensate. The chromatograph may be in data communication with the PLC to report the analysis of the sample. The chromatograph may be configured to only analyze the sample for specific hydrocarbons to minimize sample analysis time. For example, the chromatograph may be configured to analyze only for C1-C5 hydrocarbons in twenty-five seconds.

In the drilling mode, the mud pump 30*d* may pump drilling fluid 60*d* from the drilling fluid tank, through the standpipe 37*p* and Kelly hose 37*h* to the top drive 5. The drilling fluid 60*d* may include a base liquid. The base liquid may be base refined or synthetic oil, water, brine, or a water/oil emulsion. The drilling fluid 60*d* may further include solids dissolved or suspended in the base liquid, such as organophilic clay, lignite, and/or asphalt, thereby forming a mud.

The drilling fluid 60*d* may flow from the Kelly hose 37*h* and into the drill string 10 via the top drive 5. The drilling fluid 60*d* may flow down through the drill string 10 and exit the drill bit 15, where the fluid may circulate the cuttings away from the bit and return the cuttings up an annulus 105 formed between an inner surface of the casing 101 or wellbore 100 and an outer surface of the drill string 10. The returns 60*r* (drilling fluid 60*d* plus cuttings) may flow through the annulus 105 to the wellhead 50. The returns 60*r* may continue from the wellhead 50 and into the riser 25 via the PCA 1*p*. The returns 60*r* may flow up the riser 25 to the RCD 26. The returns 60*r* may be diverted by the RCD 26 into the return line 29 via the RCD outlet. The returns 60*r* may continue from the return line 29, through the open (depicted by phantom) first shutoff valve 38*a* and first tee 39*a*, and into the first spool. The returns 60*r* may flow through the MP choke 36*a*, the flow meter 34*r*, the gas detector 31, and the open fourth shutoff valve 38*d* to the third tee 39*c*. The returns 60*r* may continue through the second splice and to the fourth tee 39*d* via the open fifth shutoff valve 38*e*. The returns 60*r* may continue through the third spool to the fifth tee 39*e* via the open seventh shutoff valve 38*g*. The returns 60*r* may then flow into the shale shaker 33 and be processed thereby to remove the cuttings, thereby completing a cycle. As the drilling fluid 60*d* and returns 60*r* circulate, the drill string 10 may be rotated 16 by the top drive 5 and lowered by the traveling block 6, thereby extending the wellbore 100 into the lower formation 104*b*.

Alternatively, the sixth 38*f* and eighth 38*h* shutoff valves may be open and the fifth 38*e* and seventh 38*g* shutoff valves may be closed in the drilling mode, thereby routing the returns 60*r* through the MGS 32 before discharge into the shaker 33.

The PLC 75 may be programmed to operate the MP choke 36*a* so that a target bottomhole pressure (BHP) is maintained in the annulus 105 during the drilling operation. The target BHP may be selected to be within a drilling window defined as greater than or equal to a minimum threshold pressure, such as pore pressure, of the lower formation 104*b* and less than or equal to a maximum threshold pressure, such as fracture pressure, of the lower formation, such as an average of the pore and fracture BHPs.

Alternatively, the minimum threshold may be stability pressure and/or the maximum threshold may be leakoff pressure. Alternatively, threshold pressure gradients may be used instead of pressures and the gradients may be at other depths along the lower formation 104*b* besides bottomhole, such as the depth of the maximum pore gradient and the depth of the minimum fracture gradient. Alternatively, the PLC 75 may be free to vary the BHP within the window during the drilling operation.

A static density of the drilling fluid 60*d* (typically assumed equal to returns 60*r*; effect of cuttings typically assumed to be negligible) may correspond to a threshold pressure gradient of the lower formation 104*b*, such as being equal to a pore pressure gradient. During the drilling operation, the PLC 75 may execute a real time simulation of the drilling operation in order to predict the actual BHP from measured data, such as standpipe pressure from sensor 35*d*, mud pump flow rate from flow meter 34*d*, wellhead pressure from any of the sensors 47*a-c*, and return fluid flow rate from flow meter 34*r*. The PLC 75 may then compare the predicted BHP to the target BHP and adjust the MP choke 36*a* accordingly.

Alternatively, a static density of the drilling fluid 60*d* may be slightly less than the pore pressure gradient such that an equivalent circulation density (ECD) (static density plus dynamic friction drag) during drilling is equal to the pore pressure gradient. Alternatively, a static density of the drilling fluid 60*d* may be slightly greater than the pore pressure gradient.

During the drilling operation, the PLC 75 may also perform a mass balance to monitor for a kick (FIG. 3C) or lost circulation (not shown). As the drilling fluid 60*d* is being pumped into the wellbore 100 by the mud pump 30*d* and the returns 60*r* are being received from the return line 29, the PLC 75 may compare the mass flow rates (i.e., drilling fluid flow rate minus returns flow rate) using the respective counters/meters 34*d,r*. The PLC 75 may use the mass balance to monitor for formation fluid 62 entering the annulus 105 and contaminating the returns 60*r* (forming contaminated returns 61*r* as seen in FIG. 3C) or returns 60*r* entering the formation 104*b*. Upon detection of either event, the PLC 75 may shift the drilling system 1 into a managed pressure riser degassing mode. The gas detector 31 may also capture and analyze samples of the returns 60*r* as an additional safeguard for kick detection.

Alternatively, the PLC 75 may estimate a mass rate of cuttings (and add the cuttings mass rate to the intake sum) using a rate of penetration (ROP) of the drill bit or a mass flow meter may be added to the cuttings chute of the shaker and the PLC may directly measure the cuttings mass rate. Alternatively, the gas detector 31 may be bypassed during the drilling operation. Alternatively, the booster pump 30*b* may be operated during drilling to compensate for any size discrepancy between the riser annulus and the casing/wellbore annulus and the PLC may account for boosting in the BHP control and mass balance using the flow meter 34*b*.

FIGS. 2A and 2B illustrate the offshore drilling system 1 in a managed pressure riser degassing mode. FIG. 2C is a table illustrating switching between the modes. To shift the drilling system 1 to degassing mode, the PLC 75 may halt injection of the drilling fluid 60*d* by the mud pump 30*d* and halt rotation 16 of the drill string 10 by the top drive 5. The Kelly valve 11 may be closed. The top drive 5 may also be raised to remove weight on the bit 15. The PLC 75 may then close one or more of the BOPs, such as annular BOP 42*a* and pipe ram BOP 42*u*, against an outer surface of the drill pipe 10*p*. The PLC 75 may close the fifth 38*e* and seventh 38*g* shutoff valves and open the sixth 38*f* and eighth 38*h* shutoff valves. The PLC 75 may then open the first booster line shutoff valve 45*a* and operate the booster pump 30*b*, thereby pumping drilling fluid 60*d* into a top of the booster line 27. The drilling fluid 60*d* may flow down the booster line 27 and into the upper flow cross 41*u* via the open shutoff valve 45*a*.

The drilling fluid 60*d* may flow through the LMRP and into a lower end of the riser 25, thereby displacing any contaminated returns 61*r* present therein. The drilling fluid 60*d* may flow up the riser 25 and drive the contaminated returns 61*r* out of the riser 25. The contaminated returns 61*r* may be driven up the riser 25 to the RCD 26. The contaminated returns 61*r* may be diverted by the RCD 26 into the return line 29 via the RCD outlet. The contaminated returns 61*r* may continue from the return line 29, through the open first shutoff valve 38*a* and first tee 39*a*, and into the first spool. The contaminated returns 61*r* may flow through the MP choke 36*a*, the flow meter 34*r*, the gas detector 31, and the open fourth shutoff valve 38*d* to the third tee 39*c*. The contaminated returns 61*r* may continue into an inlet of the MGS 32 via the open sixth shutoff valve 38*f*. The MGS 32 may degas the contaminated returns 61*r* and a liquid portion thereof may be discharged into the third splice. The liquid portion of the contaminated returns 61*r* may continue into the shale shaker 33 via the open eighth shutoff valve 38*h* and the fifth tee 39*e*. The shale shaker 33 may process the contaminated liquid portion to remove the cuttings and the processed contaminated liquid portion may be diverted into a disposal tank (not shown).

As the riser 25 is being flushed, the gas detector 31 may capture and analyze samples of the contaminated returns 61*r* to ensure that the riser 25 has been completely degassed. Once the riser 25 has been degassed, the PLC 75 may shift the drilling system 1 into managed pressure well control mode. If the event that triggered the shift was lost circulation, the returns 60*r* may or may not have been contaminated by fluid from the lower formation 104*b*.

Alternatively, if the booster pump 30*b* had been operating in drilling mode to compensate for any size discrepancy, then the booster pump 30*b* may or may not remain operating during shifting between drilling mode and riser degassing mode.

Figure 3A:
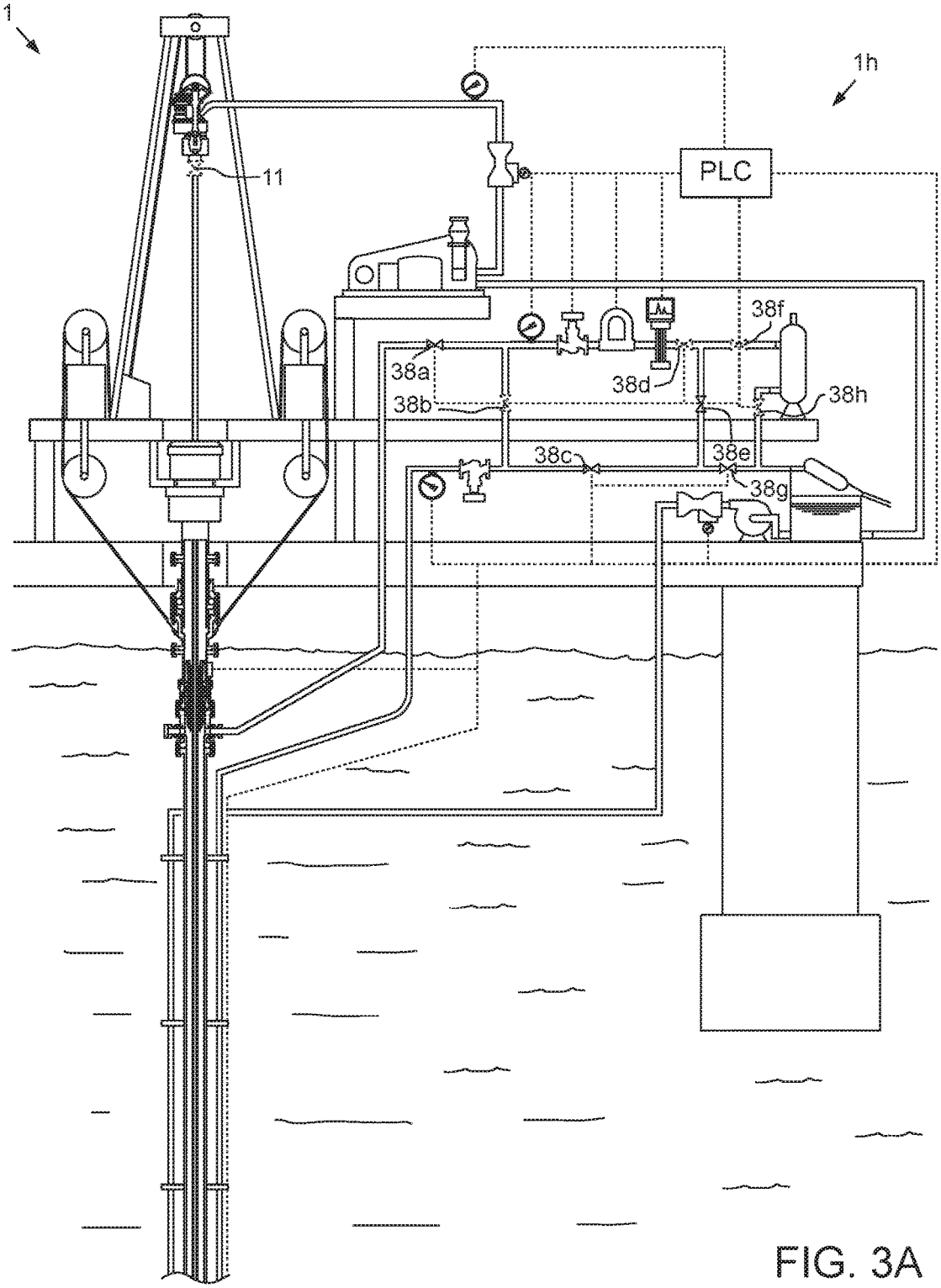
FIGS. 3A and 3B illustrate the offshore drilling system in a managed pressure well control mode.
Figure 3B:
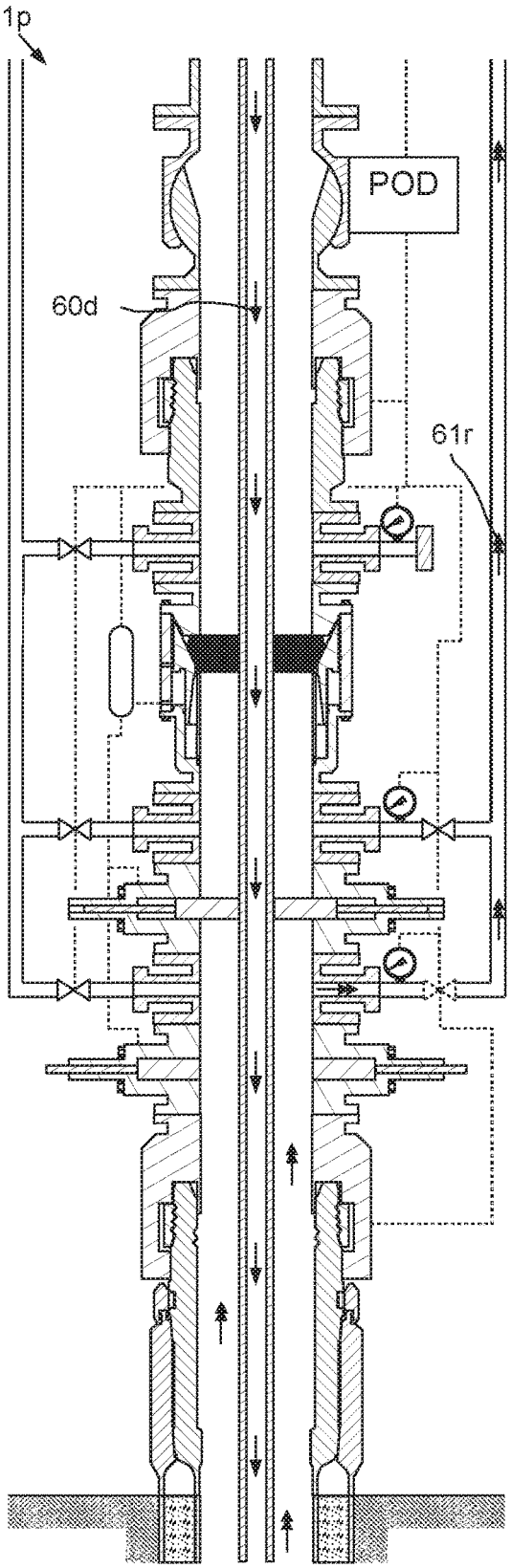
Figure 3C:
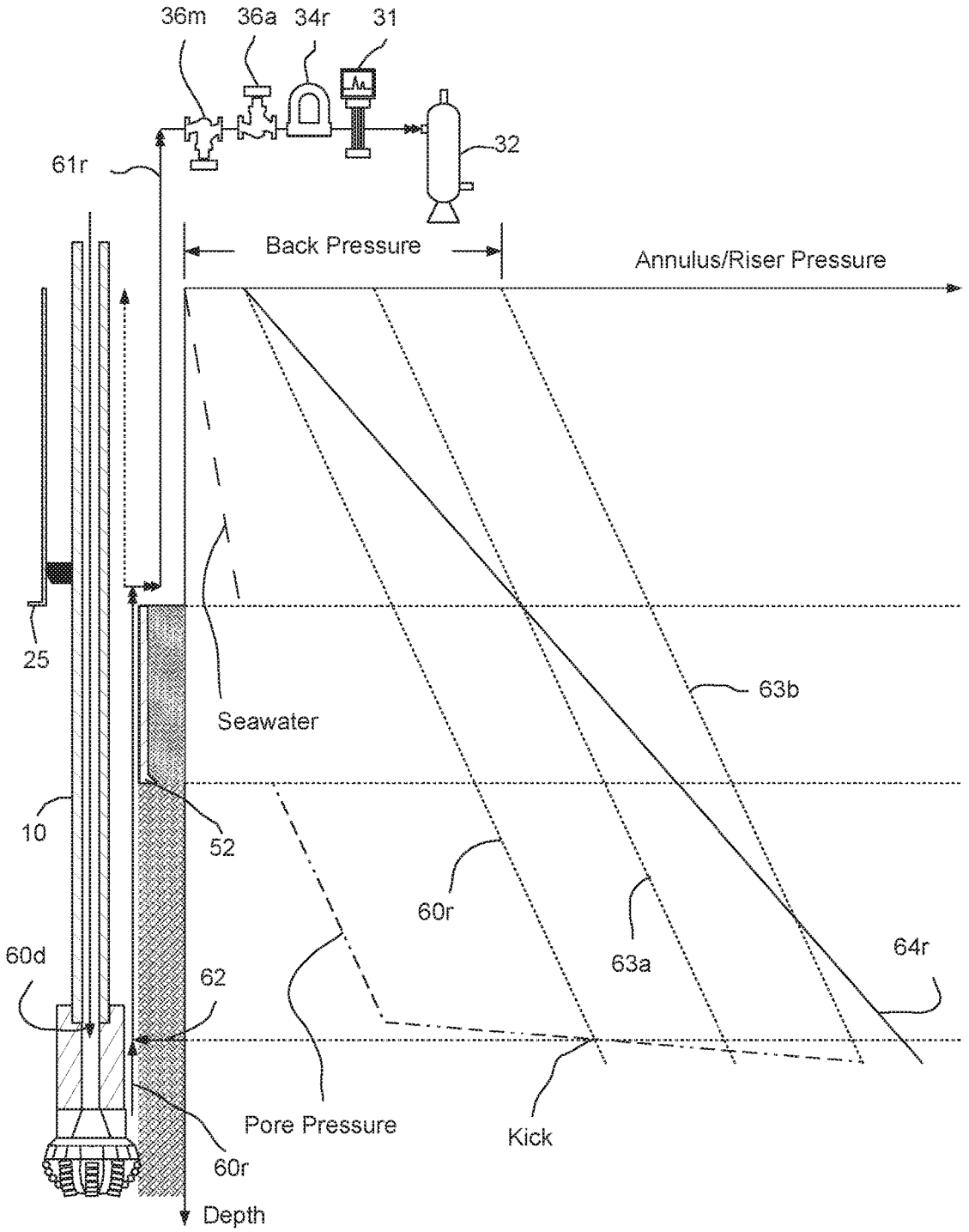
FIG. 3C illustrates operation of the PLC in the managed pressure well control mode.

FIGS. 3A and 3B illustrate the offshore drilling system 1 in a managed pressure well control mode. To shift the drilling system 1 to the managed pressure well control mode, the PLC 75 may halt injection of the drilling fluid 60*d* by the booster pump 30*b* and close the booster line shutoff valve 45*a*. The Kelly valve 11 may be opened. The PLC 75 may close the first shutoff valve 38*a* and open the second shutoff valve 38*b*. The PLC 75 may then open the second choke line shutoff valve 45*e* and operate the mud pump 30*d*, thereby pumping drilling fluid 60*d* into a top of the drill string 10 via the top drive 5. The drilling fluid 60*d* may be flow down through the drill string 10 and exit the drill bit 15, thereby displacing the contaminated returns 61*r* present in the annulus 105. The contaminated returns 61*r* may be driven through the annulus 105 to the wellhead 50. The contaminated returns 61*r* may be diverted into the choke line 28 by the closed BOPs 41*a,u* and via the open shutoff valve 45*e*. The contaminated returns 61*r* may be driven up the choke line 28 to the WC choke 36*m*. The WC choke 36*m* may be fully relaxed or be bypassed.

The contaminated returns 61*r* may continue through the WC choke 36*m* and into the first branch via the second tee 39*b*. The contaminated returns 61*r* may flow into the first spool via the open second shutoff valve 38*b* and first tee 39*a*. The contaminated returns 61*r* may flow through the MP choke 36*a*, the flow meter 34*r*, the gas detector 31, and the open fourth shutoff valve 38*d* to the third tee 39*c*. The contaminated returns 61*r* may continue into the inlet of the MGS 32 via the open sixth shutoff valve 38*f*. The MGS 32 may degas the contaminated returns 61*r* and a liquid portion thereof may be discharged into the third splice. The liquid portion of the contaminated returns 61*r* may continue into the shale shaker 33 via the open eighth shutoff valve 38*h* and the fifth tee 39*e*. The shale shaker 33 may process the contaminated liquid portion to remove the cuttings and the processed contaminated liquid portion may be diverted into a disposal tank (not shown).

FIG. 3C illustrates operation of the PLC 75 in the managed pressure well control mode. A flow rate of the mud pump 30*d* for managed pressure well control may be reduced relative to the flow rate of the mud pump during the drilling mode to account for the reduced flow area of the choke line 28 relative to the flow area of the a riser annulus formed between the riser 25 and the drill string 10. If the trigger event was a kick, as the drilling fluid 60*d* is being pumped through the drill string 10, annulus 105, and choke line 28, the gas detector 31 may capture and analyze samples of the contaminated returns 61*r* and the flow meter 34*r* may be monitored so the PLC 75 may determine a pore pressure of the lower formation 104*b*. If the trigger event was lost circulation (not shown), the PLC 75 may determine a fracture pressure of the formation. The pore/fracture pressure may be determined in an incremental fashion, i.e. for a kick, the MP choke 36*a* may be monotonically or gradually tightened 63*a,b* until the returns are no longer contaminated with production fluid 62. Once the back pressure that ended the influx of formation is known, the PLC 75 may calculate the pore pressure to control the kick. The inverse of the incremental process may be used to determine the fracture pressure for a lost circulation scenario.

Once the PLC 75 has determined the pore pressure, the PLC may calculate a pore pressure gradient and a density of the drilling fluid 60*d* may be increased to correspond to the determined pore pressure gradient. The increased density drilling fluid may be pumped into the drill string 10 until the annulus 105 and choke line 28 are full of the heavier drilling fluid. The riser 25 may then be filled with the heavier drilling fluid. The PLC 75 may then shift the drilling system 1 back to drilling mode and drilling of the wellbore 100 through the lower formation 104*b* may continue with the heavier drilling fluid such that the returns 64*r* therefrom maintain at least a balanced condition in the annulus 105.

Should the kick be severe such that the back pressure exerted by the MP choke 36*a* approaches a maximum operating pressure of the first spool, the WC choke 36*m* may be tightened (or brought online if bypassed) to alleviate pressure from the MP choke 36*a* until the kick has been controlled. Since the WC choke 36*m* is located upstream of the first spool, the chokes 36*a,m* may operate in a serial fashion. The WC choke 36*m* may function as a high pressure stage and the MP choke 36*a* may function as a low pressure stage, thereby effectively increasing a maximum operating pressure of the first spool. Should tightening the chokes 36*a,m* fail to control the kick, the PLC 75 may shift the drilling system into emergency well control mode.

Figure 4A:
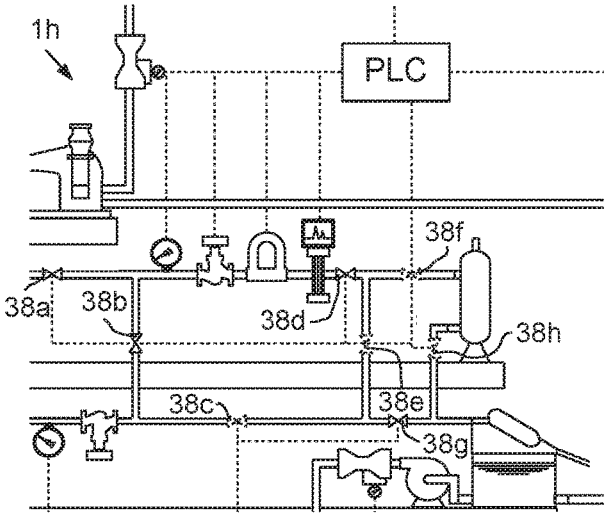
FIGS. 4A and 4B illustrate the offshore drilling system in an emergency well control mode.
Figure 4B:
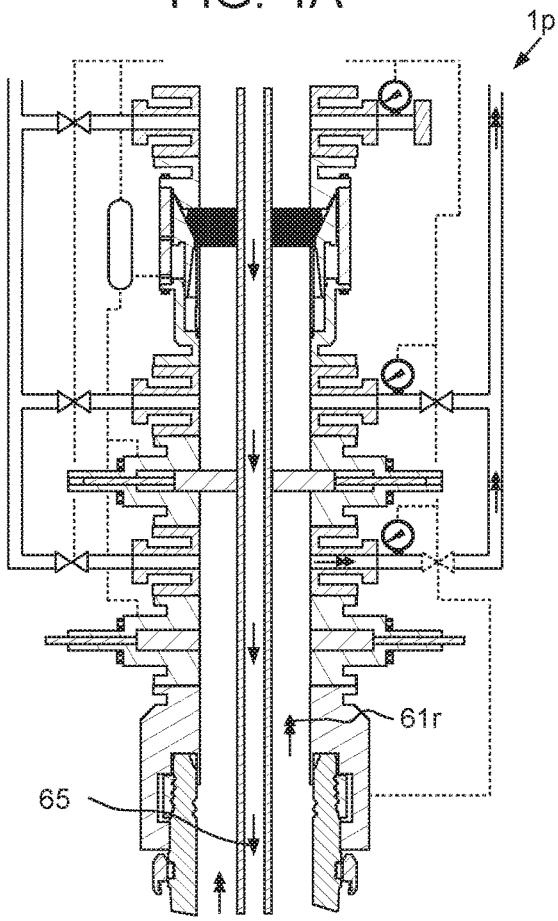

FIGS. 4A and 4B illustrate the offshore drilling system 1 in an emergency well control mode. To shift the drilling system 1 to the emergency well control mode, the PLC 75 may halt injection of the drilling fluid 60*d* by the mud pump 30*b* and close the second 38*b* and fourth 38*d* shutoff valves and open the fifth shutoff valve 38*e*. The PLC 75 may close a supply valve (not shown) for the mud pump 30*d* from the drilling fluid tank and open a supply valve (not shown) for the mud pump 30*d* from a kill fluid tank (not shown). The PLC 75 may then operate the mud pump 30*d*, thereby pumping kill fluid 65 into a top of the drill string 10 via the top drive 5. The kill fluid 65 may be flow down through the drill string 10 and exit the drill bit 15, thereby displacing the contaminated drilling fluid present in the annulus 105. The contaminated drilling fluid may be driven through the annulus 105 to the wellhead 50. The contaminated drilling fluid may be diverted into the choke line 28 by the closed BOPs 41*a,u* and via the open shutoff valve 45. The contaminated drilling fluid may be driven up the choke line 28 to the WC choke 36*m*.

The contaminated drilling fluid may continue through the WC choke 36*m* and into the second spool via the second tee 39*b*. The contaminated drilling fluid may flow into the second branch via the open third shutoff valve 38*c* and fourth tee 39*d*. The contaminated drilling fluid may bypass the first spool and continue into the inlet of the MGS 32 via the open fifth 38*e* and 38*f* sixth shutoff valves. The MGS 32 may degas the contaminated drilling fluid and a liquid portion thereof may be discharged into the third splice. The liquid portion of the contaminated drilling fluid may continue into the shale shaker 33 via the open eighth shutoff valve 38*h* and the fifth tee 39*e*. The processed contaminated liquid portion may be diverted into a disposal tank (not shown). The WC choke 36*m* may be operated to bring the kick under control.

Figure 5:
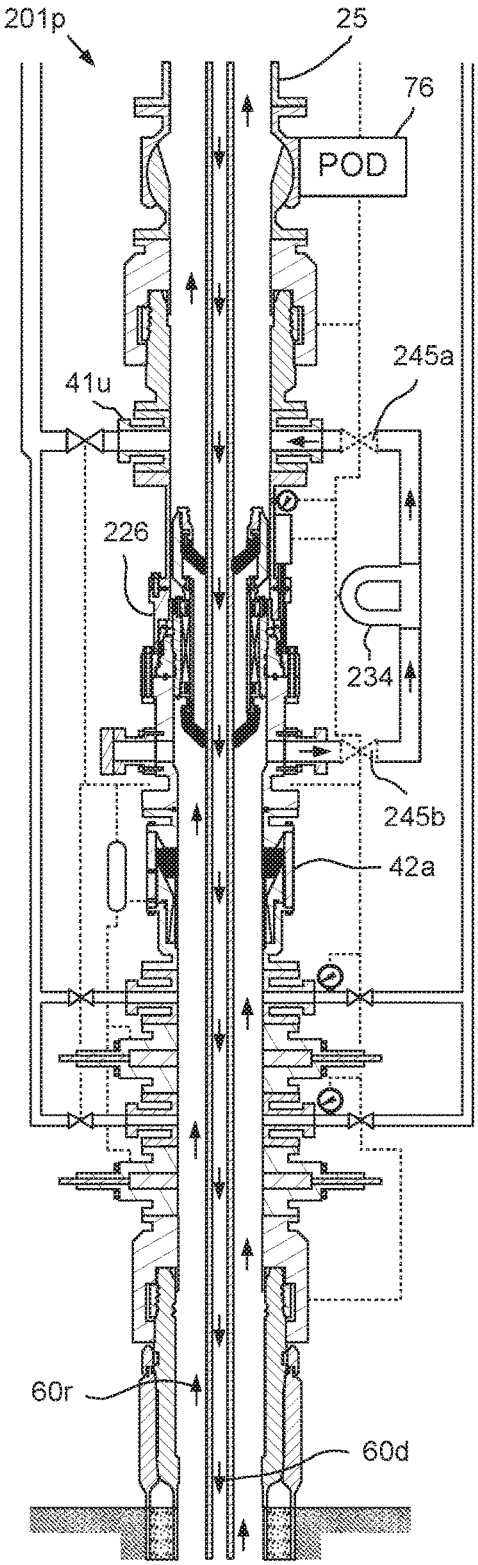
FIG. 5 illustrates a pressure control assembly (PCA) of a second offshore drilling system in a managed pressure drilling mode, according to another embodiment of the present disclosure.

FIG. 5 illustrates a pressure control assembly (PCA) of a second offshore drilling system in a managed pressure drilling mode, according to another embodiment of the present disclosure. The second drilling system may include the MODU 1*m*, the drilling rig 1*r*, the fluid handling system 1*h*, the fluid transport system 1*t*, and a pressure control assembly (PCA) 201*p*. The PCA 201*p* may include the wellhead adapter 40*b*, the one or more flow crosses 41*u,m,b*, the blow out preventers (BOPs) 42*a,u,b*, the LMRP, the accumulators 44, the receiver 46, a second RCD 226, and a subsea flow meter 234.

The second RCD 226 may be similar to the first RCD 26. A lower end of the second RCD housing may be connected to the annular BOP 42*a* and an upper end of the second RCD housing may be connected to the upper flow cross 41*u*, such as by flanged connections. A pressure sensor may be connected to an upper housing section of the second RCD 226. The pressure sensor may be in data communication with the control pod 76 and the second RCD latch piston may be in fluid communication with the control pod via an interface of the second RCD 226.

A lower end of a subsea spool may be connected to an outlet of the second RCD 226 and an upper end of the spool may be connected to the upper flow cross 41*u*. The spool may have first 245*a* and second 245*b* shutoff valves and the subsea flow meter 234 assembled as a part thereof. Each shutoff valve 245*a,b* may be automated and have a hydraulic actuator (not shown) operable by the control pod 76 via fluid communication with a respective umbilical conduit or the LMRP accumulators 44. The subsea flow meter 234 may be a mass flow meter, such as a Coriolis flow meter, and may be in data communication with the PLC 75 via the pod 76 and the umbilical 70.

Alternatively, a subsea volumetric flow meter may be used instead of the mass flow meter.

In the drilling mode, the returns 60*r* may flow through the annulus 105 to the wellhead 50. The returns 60*r* may continue from the wellhead 50 to the second RCD 226 via the BOPs 42*a,u,b*. The returns 60*r* may be diverted by the second RCD 226 into the subsea spool via the second RCD outlet. The returns 60*r* may flow through the open second shutoff valve 245*b*, the subsea flow meter 234, and the first shutoff valve 245*a* to a branch of the upper flow cross 41*u*. The returns 60*r* may flow into the riser 25 via the upper flow cross 41*u*, the receiver 46, and the LMRP. The returns 60*r* may flow up the riser 25 to the first RCD 26. The returns 60*r* may be diverted by the first RCD 26 into the return line 29 via the first RCD outlet. The returns 60*r* may continue from the return line 29, through the open first shutoff valve 38*a* and first tee 39*a*, and into the first spool. The returns 60*r* may flow through the MP choke 36*a*, the flow meter 34*r*, the gas detector 31, and the open fourth shutoff valve 38*d* to the third tee 39*c*. The returns 60*r* may continue through the second splice and to the fourth tee 39*d* via the open fifth shutoff valve 38*e*. The returns 60*r* may continue through the third spool to the fifth tee 39*e* via the open seventh shutoff valve 38*g*. The returns 60*r* may then flow into the shale shaker 33 and be processed thereby to remove the cuttings, thereby completing a cycle.

During the drilling operation, the PLC may rely on the subsea flow meter 234 instead of the surface flow meter 34*r* to perform BHP control and the mass balance. The surface flow meter 34*r* may be used as a backup to the subsea flow meter 234 should the subsea flow meter fail.

The degassing, well control, and emergency modes for the PCA 201*p* may be similar to that of the PCA 1*p*.

While the foregoing is directed to embodiments of the present disclosure, other and further embodiments of the disclosure may be devised without departing from the basic scope thereof, and the scope of the invention is determined by the claims that follow.

The invention claimed is:

1. A method of managing drilling pressures comprising:
flowing returns through a returns line from a downhole tubular to a first spool, the first spool comprising a managed pressure ("MP") choke;
flowing returns through a choke line from the downhole tubular to a well control ("WC") choke;
flowing returns from the WC choke to the MP choke through a splice line connecting the choke line to the returns line; and
tightening at least one of the MP choke and the WC choke.

2. The method of claim 1, further comprising closing a shutoff valve between the downhole tubular and the MP choke before flowing returns from the WC choke to the MP choke.

3. The method of claim 1, further comprising opening a shutoff valve between the WC choke and the MP choke before flowing returns from the WC choke to the MP choke.

4. The method of claim 1, wherein the first spool further comprises:
a pressure sensor;
a flow meter; and
a gas detector.

5. The method of claim 4, further comprising monitoring backpressure exerted by the MP choke with the pressure sensor.

6. The method of claim 4, further comprising monitoring flow rate of the returns with the flow meter.

7. The method of claim 4, further comprising analyzing samples of the returns with the gas detector.

8. The method of claim 1, further comprising monitoring backpressure exerted by the WC choke with a pressure sensor in the choke line.

9. The method of claim 1, wherein tightening at least one of the MP choke and the WC choke comprises gradually tightening the at least one of the MP choke and the WC choke.

10. The method of claim 1, further comprising:
tightening the MP choke until a back pressure exerted by the MP choke approaches a maximum operating pressure of the first spool; and
in response to the back pressure approaching the maximum operating pressure, tightening the WC choke.

11. The method of claim 1, further comprising operating the WC choke and the MP choke in a serial fashion, wherein the WC choke functions as a high pressure stage and the MP choke functions as a low pressure stage.

12. The method of claim 1, further comprising detecting a kick, and controlling the kick.

13. The method of claim 12, further comprising, after controlling the kick, opening a shutoff valve between the downhole tubular and the MP choke.

14. The method of claim 12, further comprising, after controlling the kick, closing a shutoff valve between the WC choke and the MP choke.

15. The method of claim 12, wherein flowing returns through the choke line and flowing returns to the MP choke occur after detecting the kick.

16. The method of claim 1, further comprising, closing a shutoff valve between the downhole tubular and the MP choke after tightening at least one of the MP choke and the WC choke, closing a shutoff valve between the WC choke and the MP choke.

17. The method of claim 1, wherein at least one of the MP choke and the WC choke is a variable choke valve.

18. A method of managing drilling pressures comprising:

flowing returns through a returns line from a downhole tubular to a first spool, the first spool comprising a managed pressure ("MP") choke;

flowing returns through a choke line from the downhole tubular to a well control ("WC") choke;

flowing returns from the WC choke to the MP choke;

tightening the MP choke until a back pressure exerted by the MP choke approaches a maximum operating pressure of the first spool; and in response to the back pressure approaching the maximum operating pressure, tightening the WC choke.

19. The method of claim 18, further comprising operating the WC choke and the MP choke in a serial fashion, wherein the WC choke functions as a high pressure stage and the MP choke functions as a low pressure stage.

20. The method of claim 18, further comprising detecting a kick and controlling the kick.

21. The method of claim 20, further comprising, after controlling the kick:

opening a shutoff valve between the downhole tubular and the MP choke; and closing a shutoff valve between the WC choke and the MP choke.

22. The method of claim 20, wherein tightening the MP choke occurs after detecting the kick.

23. A method of managing drilling pressures comprising:

flowing returns through a returns line from a downhole tubular to a first spool, the first spool comprising a managed pressure ("MP") choke;

detecting a kick occurring in a wellbore; and in response to detecting the kick:

flowing returns through a choke line from the downhole tubular to a well control ("WC") choke;

flowing returns from the WC choke to the MP choke; and tightening at least one of the MP choke and the WC choke.

24. A method of managing drilling pressures comprising:

flowing returns through a returns line from a downhole tubular to a first spool, the first spool comprising a managed pressure ("MP") choke;

detecting a lost circulation occurring in a wellbore; and in response to detecting the lost circulation:

flowing returns through a choke line from the downhole tubular to a well control ("WC") choke;

flowing returns from the WC choke to the MP choke; and loosening at least one of the MP choke and the WC choke.

* * * * *